US005970899A

United States Patent [19]

Michaelson et al.

[11] Patent Number: 5,970,899

[45] Date of Patent: Oct. 26, 1999

[54] DIAGONAL HATCH SYSTEM FOR SHIPS

[75] Inventors: Robert W. Michaelson, Annapolis; Jerome P. Sikora, Rockville, both of Md.

[73] Assignee: The United States of America as represented by the Secretary of the Navy, Washington, D.C.

[21] Appl. No.: 08/911,267

[22] Filed: Aug. 14, 1997

[51] Int. Cl.[6] ..... B63B 3/00

[52] U.S. Cl. ..... 114/85; 114/65 R

[58] Field of Search ..... 114/65 R, 65 A, 114/72, 73, 74 R, 74 A, 76, 77 R, 77 A, 78, 79 R, 79 W, 85, 201 R; 52/634, 636, 638, 648.1, 650.3, 651.01

[56] References Cited

U.S. PATENT DOCUMENTS

| | | | |
|---|---|---|---|
| 1,563,118 | 11/1925 | Tonnelier | 52/634 |
| 2,177,277 | 10/1939 | Burke | 52/634 |
| 3,552,345 | 1/1971 | Harlander et al. | 114/72 |
| 3,827,384 | 8/1974 | Lunde et al. | 114/72 |
| 3,903,667 | 9/1975 | Zetlin | 52/227 |
| 3,907,147 | 9/1975 | Goobeck | 220/1.5 |
| 4,003,327 | 1/1977 | Finsterwalder | 114/74 R |
| 4,043,285 | 8/1977 | Nordstrom | 114/72 |
| 4,082,051 | 4/1978 | Timmann et al. | 114/72 |
| 4,172,685 | 10/1979 | Nabeshima et al. | 414/139 |
| 4,232,493 | 11/1980 | Gray et al. | 52/221 |
| 4,329,935 | 5/1982 | Jonasson | 114/72 |
| 4,426,824 | 1/1984 | Swensen | 52/794 |
| 4,606,156 | 8/1986 | Sweers et al. | 52/126.6 |
| 4,621,468 | 11/1986 | Likozar | 52/126.6 |
| 4,625,670 | 12/1986 | Igielska | 114/78 |
| 4,630,561 | 12/1986 | Franz et al. | 114/1 |
| 4,658,747 | 7/1987 | Franz et al. | 114/85 |
| 4,850,163 | 7/1989 | Kobayashi et al. | 52/126.6 |
| 4,890,565 | 1/1990 | Kelly et al. | 114/72 |
| 4,892,052 | 1/1990 | Zook et al. | 114/85 |
| 4,904,142 | 2/1990 | Sato | 414/142.6 |
| 5,014,370 | 5/1991 | Stark, Sr. | 4/505 |
| 5,090,353 | 2/1992 | Ellis | 114/72 |
| 5,205,091 | 4/1993 | Brown | 52/126.6 |
| 5,299,520 | 4/1994 | Wilts . | |
| 5,406,901 | 4/1995 | Ellis | 114/72 |
| 5,588,273 | 12/1996 | Csagoly | 52/634 |

OTHER PUBLICATIONS

Ralf Baade, Friedrich Klinge, Kevin Lynaugh and Frank Woronkowicz, "Modular Outfitting," *Journal of Ship Production,* vol. 14, No. 3, Aug. 1998, pp. 170–179.

*Primary Examiner*—Ed Swinehart
*Attorney, Agent, or Firm*—Howard Kaiser

[57] ABSTRACT

A ship has at least one deck which is inventively latticed in a regular (e.g., repeating) geometric pattern of hatches. The hatches of each such inventive deck are shaped in standardized geometric forms and disposed in diagonally contiguous interrelationships, thereby enhancing the structural characteristics of the deck and of the ship, especially in terms of attenuation of warping deflections and resultant stresses.

25 Claims, 4 Drawing Sheets

DIAGONAL HATCH SYSTEM FOR SHIPS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to structures for human accommodation, more particularly to construction or architecture of such structures, terrestrial or aquatic, having one or more relatively large interior openings.

Certain types of marine vessels, such as container ships, have large interior openings (in marine terminology, "hatches") which permit and facilitate access, e.g., to cargo, interior spaces and modular payloads. Conventionally, cargo hatches are large rectangular openings in the deck which allow for easy loading and discharge of cargo; typically, such rectangular openings replace a substantial portion of the deck area, thereby leaving a significantly reduced deck structure.

This reduction of the deck structure in conventionally constructed ships can present structural difficulties. In effect to some degree, a conventionally constructed cargo ship with large hatch openings has an "open" top and is thus analogous to a shoe box; subjection to strains of the conventionally constructed ship which has large openings can cause the ship to behave in a similar manner as would a shoe box under similar circumstances.

In particular, if the conventionally constructed ship having large hatches is subjected to a twisting load, the structurally reduced deck has reduced rigidity and hence reduced ability to control the deflections from this twist. Such deflections can have adverse effects; for example, large stresses at the hatch corners can lead to structural failure.

Conventional approaches to addressing these concerns have involved the utilization of structural reinforcement. One methodology has included increasing the thickness of the plating in the deck structure. Another methodology has included the addition of longitudinal box girders to increase the torsional and longitudinal rigidity of the ship hull.

SUMMARY OF THE INVENTION

In view of the foregoing, it is an object of the present invention to provide, for a marine vessel, a hatch system which renders an improved structural response of the marine vessel to torsional and other loads.

It is another object of this invention to provide such a hatch system which does not entail utilization of auxiliary structure.

The present invention features an approximately planar structure which is provided with a plurality of voids. An inventive void is described herein as "geometric" so as to impart the notion that the void approximately defines a closed plane figure wherein the perimeter has particular geometric characteristics in terms of length, straightness, curvature and angularity. For most inventive embodiments the voids are preferably distributed in a regular pattern, i.e., conforming to some principle of order, symmetry, periodicity, repetition, recurrence, uniformity and/or homogeneity; the voids are thus arranged in a cross-diagonal motif which enhances the ability to withstand stresses, strains and deflections when the structure is utilized partitionally, e.g., as a floor, platform or deck, in the context of a plural-level structure such as a building, ship or other comparatively large edifice.

The inventive apertural network is especially advantageous when used in connection with marine vessels which, when at sea, are subjected to various forms of potentially damaging or deforming loads. The present invention can be practiced in association with various marine vessel hull forms or types, in particular either with conventional single hull framing or with double hull framing. Container ships are a notable genre of marine vessels which can particularly avail this invention.

In marine applications, especially, this invention efficiently and efficaciously utilizes structural material which is included in the construction of one or more decks or one or more portions thereof. The diagonally crisscross hatch pattern of the present invention adds torsional rigidity to the ship structure, thereby controlling, mitigating or reducing the warping deflections and resulting stresses. Conventional measures for controlling high stresses due to hull warping, such as increasing plating thickness or otherwise implementing complex detail or reinforcement, can thus be obviated or avoided by this invention.

In testing conducted by the U.S. Navy, a finite element model was analyzed whereby the model was subjected to twisting loading. The resultant stresses of the model were shown to be about three to four times less than would ensue if a typical rectangular-hatch ship were subjected to such loading.

Moreover, this invention's configurational standarization of the openings accommodates the modularity which is typical of cargo containment; items of same or similar form or dimension (modules, containerized cargo, payloads, etc.) can be inserted into the openings. In fact, inventive practice can dictate shapes and sizes of the openings in conformity with, or otherwise in anticipation of, the shapes and sizes of the entitities to be passed therethrough.

Commercial container ships are among the various genres of marine vessels which can avail the present invention. Container ships are used for transporting cargos which typically are containerized or modularized in rectangular form; hence, container ships conventionally have large rectangular hatches to accommodate such rectangular cargos. The present invention can afford structural benefits to container ships while still accommodating their rectangularly shaped cargos.

For some marine applications, the inventive diagonal hatch system includes diagonal hatch patterns on each of a plurality of decks, at least two of which can be vertically adjacent decks; such repetition of the inventive hatch pattern on one or more internal decks, in addition to the top deck, can accommodate entities (e.g., cargo modules) of virtually any desired depth inside the hull.

In accordance with many embodiments of this invention, a plural-level structure comprises at least one partition which approximately defines a horizontal plane for separating two vertically consecutive levels of the plural-level structure. The partition is provided with at least four apertures for permitting communication between the two separated levels. The apertures are arranged, in the partition, in a plural number of tiers rows which are approximately parallel with respect to each other. This plural-tier arrangement is characterized by an approximately parallelly iterative positively diagonal apertural alignment mode and an approximately parallelly iterative negatively diagonal apertural alignment mode, whereby successive apertures in each positively diagonal apertural alignment have abutting sides which are approximately parallel to each other and which are approximately perpendicular to the positively diagonal apertural alignment, and whereby successive apertures in each negatively diagonal apertural alignment have abutting sides which are approximately parallel to each other and which are approximately perpendicular to the negatively diagonal apertural alignment.

According to some inventive embodiments, a plural-level structure comprises at least two vertically consecutive partitions for separating at least three vertically consecutive levels of the plural-level structure. Each partition is approximately identically provided with at least four geometric (e.g., polygonal) apertures for permitting communication between at least three separated levels. At least two consecutive partitions are configured with respect to one another whereby the corresponding plural-tier arrangements are approximately in vertical spatial alignment.

According to some embodiments of the present invention, a plural-level structure comprises at least one wall (in marine terminology, "bulkhead") which engages at least one partition. The wall traverses or substantially traverses the partition while circumventing one or more neighboring apertures. According to some such embodiments, the wall borders upon at least a portion of each of at least two apertures.

For embodiments wherein a plurality of inventively apertured partitions are provided in approximate vertical apertural alignment, at least one wall can be provided which engages at least two such partitions, wherein the wall at least substantially traverses each partition while circumventing one or more neighboring apertures in each partition; according to some such embodiments, the wall borders upon at least a portion of each of at least two apertures corresponding to each partition. In fact, some such inventive embodiments provide at least one such wall which at least partially extends (in an approximately vertical direction) into each of at least two levels, thereby intersecting at least one partition.

When the plural-level structure is a marine vessel (such as a cargo ship or a military ship), it may be particularly beneficial in inventive practice to orient the tiers approximately longitudinally with respect to the marine vessel, i.e., so that the tiers are not only approximately parallel to each other but are also approximately parallel to the imaginary longitudinal axis of the marine vessel. With the tiers of the hatches being thus oriented, the diagonally crosswise distribution of the hatches can more optimally serve to amplify or embellish resistance of the marine vessel to deflections and stresses of one or more decks due to warping or twisting of the hull.

According to most embodiments of the present invention, at least one pair of adjacent positively diagonal alignments define therebetween a positively diagonal traversal of the plural-tier arrangement, and at least one pair of adjacent negatively diagonal alignments define therebetween a negatively diagonal traversal of the plural-tier arrangement. This inventive featural aspect of cross-diagonal structural continuums can contribute to the overall structural fortification afforded by the present invention; this beneficial effect may be heightened by a regularity of the inventive apertural pattern, in that the cross-diagonal structural continuums would likewise be characterized by a type of regularity of distribution. When used in association with a marine vessel, for example, the cross-diagonal structural continuums of an inventively hatched deck can extend at least substantially across the marine vessel (from port to starboard) and, like a truss or rigid framework, thereby afford a structurally supportive quality. At the same time, the inventive cross-diagonal apertural lattice can afford a structurally resiliant quality in response to stresses, strains and deflections.

Many inventive embodiments provide a positively diagonal apertural alignment mode and a negatively diagonal apertural alignment mode which are at an approximately equal orientation with respect to the direction of the tiers (and hence at an approximately equal orientation with respect to the direction of the marine vessel's longitudinal axis); for most such embodiments, this orientation is in the approximate range between 30° and 60°. Some such inventive embodiments provide a positively diagonal apertural alignment mode and a negatively diagonal apertural alignment mode which are each oriented at approximately 45° with respect to the direction of the tiers (and hence at approximately 45° with respect to the direction of the marine vessel's longitudinal axis) and are thus oriented approximately orthogonally with respect to each other.

A noteworthy class of inventive embodiments includes a two-tier arrangement of approximately congruent symmetrical hexagonal hatches. Each hexagonal hatch has a double-right-angle-interposed side, a positively beveled side and a negatively beveled side. Every beveled side has approximately the same length. Each tier has its own hexagonal apertures approximately equivalently situated so that their double-right-angle-interposed sides face opposite the other tier. The abutting sides for each positively diagonal alignment comprise two negatively beveled sides. The abutting sides for each negatively diagonal alignment comprise two positively beveled sides.

Another noteworthy class of inventive embodiments includes a three-tier arrangement of hatches. Two outer tiers are of approximately congruent symmetrical hexagonal apertures. An intermediate tier is of approximately congruent symmetrical octagonal apertures. Each hexagonal aperture has a double-right-angle-interposed side, a positively beveled side and a negatively beveled side. Each outer tier has its own hexagonal apertures approximately equivalently situated so that their double-right-angle-interposed sides face opposite the intermediate tier. Each octogonal aperture has two positively beveled sides and two negatively beveled sides. Every beveled side has approximately the same length. The abutting sides for each positively diagonal alignment comprise at least one pair of negatively beveled sides. The abutting sides for at least one positively diagonal alignment comprise two pairs of the negatively beveled sides. The abutting sides for each negatively diagonal alignment comprise at least one pair of positively beveled sides. The abutting sides for at least one negatively diagonal alignment comprise two pairs of positively beveled sides.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

DETAILED DESCRIPTION OF THE INVENTION

Figure 1:
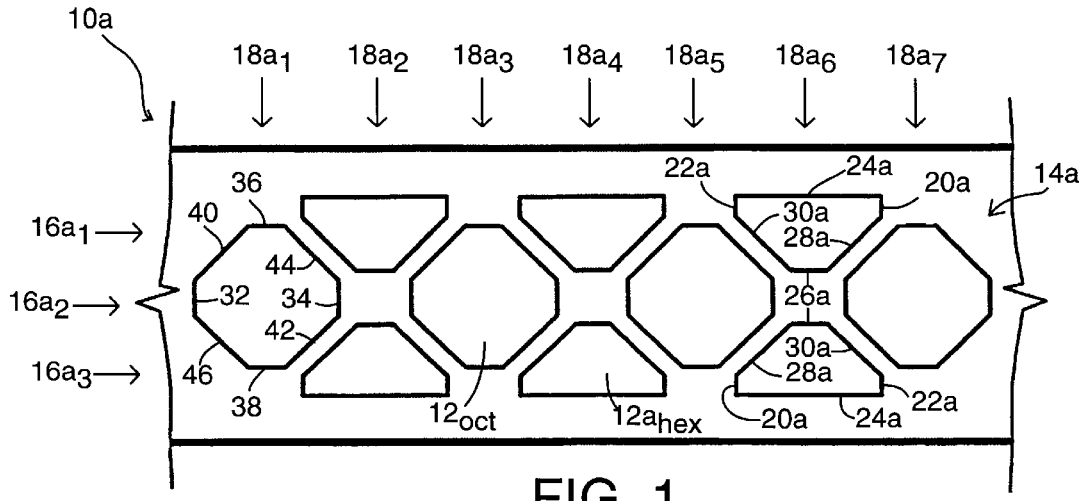
FIG. 1 is a partial plan view of an inventive deck embodiment, wherein the deck is provided with hexagonally and octagonally shaped voids.

Referring now to FIG. 1, deck 10*a* is an approximately planar structure having a plurality of hexagonal hatches $\mathbf{12}a_{hex}$ and octagonal hatches $\mathbf{12}_{oct}$. Rectangular array 14*a* has three horizontal rows and several vertical columns of hexagonal hatches $\mathbf{12}a_{hex}$ and octagonal hatches $\mathbf{12}_{oct}$.

First row $\mathbf{16}a_1$ and third row $\mathbf{16}a_3$ are the outer rows, and second row $\mathbf{16}a_2$ is the intermediate row. First row 16*a*, and third row $\mathbf{16}a_3$ each have a plurality of hexagonal hatches $\mathbf{12}a_{hex}$. Second row $\mathbf{16}a_2$ has a plurality of octagonal hatches $\mathbf{12}_{oct}$. The columns alternate between having two hexagonal hatches $\mathbf{12}a_{hex}$ and having one octagonal hatch $\mathbf{12}_{oct}$. As shown in FIG. 1, columns $\mathbf{18}a_1$, $\mathbf{18}a_3$, $\mathbf{18}a_7$ each have one octagonal hatch $\mathbf{12}_{oct}$; columns $\mathbf{18}a_2$, $18a_4$ and $\mathbf{18}a_6$ each have two hexagonal hatches $\mathbf{12}a_{hex}$.

Every opening in first row $\mathbf{16}a_1$ and third row $\mathbf{16}a_3$ is an approximately congruent hexagonal hatch $\mathbf{12}a_{hex}$. Every hexagonal hatch $\mathbf{12}a_{hex}$ is a rectanguloid which has a pair of approximately parallel approximately equal columnwise hexagonal sides 20*a* and 22*a*, a pair of approximately parallel unequal rowwise hexagonal sides 24*a* and 26*a*, and a pair of approximately equal hexagonal oblique sides 28*a* and 30*a* adjoining the ends of the shorter rowwise hexagonal side 26*a*.

Every opening in second row $\mathbf{16}a_2$ is an approximately congruent octagonal hatch $\mathbf{12}_{oct}$. Every octagonal hatch $\mathbf{12}_{oct}$ has a pair of approximately parallel approximately equal columnwise octagonal sides 32 and 34, a pair of approximately parallel approximately equal rowwise octagonal sides 36 and 38, a first pair of approximately parallel approximately equal oblique octagonal sides 40 and 42, and a second pair of approximately parallel approximately equal oblique octagonal sides 44 and 46. Each oblique octagonal side 40, 42, 44, and 46 adjoins an end of a columnwise octagonal side 32 or 34 and an end of a rowwise octagonal side 36 or 38.

For every hexagonal hatch $\mathbf{12}a_{hex}$, the longer rowwise hexagonal side 24*a* faces outwardly with respect to array 14*a*. Every hexagonal hatch $\mathbf{12}a_{hex}$ in first row $\mathbf{16}a_1$ is oriented approximately equally with respect to each other. Every octagonal hatch $\mathbf{12}_{oct}$ in second row $\mathbf{16}a_2$ is oriented approximately equally with respect to each other. Every hexagonal hatch $\mathbf{12}a_{hex}$ in third row $\mathbf{16}a_3$ is oriented approximately equally with respect to each other and approximately invertedly with respect to the hexagonal hatches $\mathbf{12}a_{hex}$ in first row $\mathbf{16}a_1$.

Figure 2:
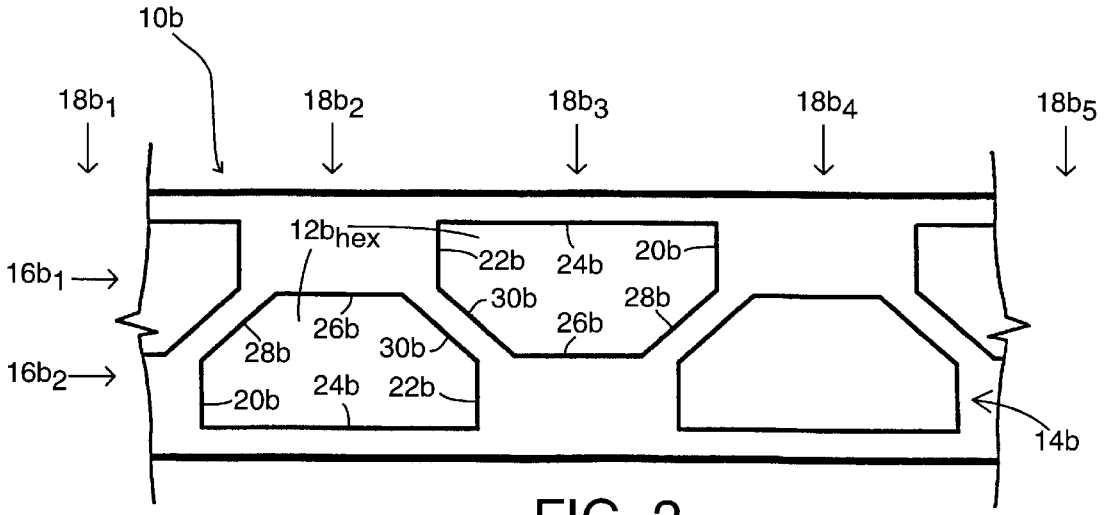
FIG. 2 is a partial plan view of another inventive deck embodiment, wherein the deck is provided with hexagonally shaped voids.

With reference to FIG. 2, deck 10*b* is an approximately planar structure having a plurality of approximately congruent hexagonal hatches $\mathbf{12}b_{hex}$. Rectangular array 14*b* has two horizontal rows and several vertical columns of hexagonal hatches $\mathbf{12}a_{hex}$. First row $\mathbf{16}b_1$ and second row $\mathbf{16}b_2$ each have a plurality of hexagonal hatches $\mathbf{12}b_{hex}$. Every column has a hexagonal hatch $\mathbf{12}b_{hex}$; as shown in FIG. 2, columns $\mathbf{18}b_1$, $\mathbf{18}b_2$, $\mathbf{18}b_3$, $\mathbf{18}b_4$ and $\mathbf{18}b_5$ each have one hexagonal hatch $\mathbf{12}b_{hex}$.

Every hexagonal hatch $\mathbf{12}b_{hex}$ is a rectanguloid which has a pair of approximately parallel approximately equal columnwise hexagonal sides 20*b* and 22*b*, a pair of approximately parallel unequal rowwise hexagonal sides 24*b* and 26*b*, and a pair of approximately equal hexagonal oblique sides 28*b* and 30*b* adjoining the ends of the shorter rowwise hexagonal side 26*b*. For every hexagonal hatch $\mathbf{12}b_{hex}$, the longer rowwise hexagonal side 24*b* faces outwardly with respect to array 14*b*. Every hexagonal hatch $\mathbf{12}b_{hex}$ in first row $\mathbf{16}b_1$ is oriented approximately equally with respect to each other. Every hexagonal hatch $\mathbf{12}b_{hex}$ in second row $\mathbf{16}b_2$ is oriented approximately equally with respect to each other and approximately invertedly with respect to the hexagonal hatches $\mathbf{12}b_{hex}$ in first row $\mathbf{16}b_1$.

Still referring to FIG. 2 and again referring to FIG. 1, it is seen that array 14*a* and array 14*b* bear certain similarities. For instance, hexagonal hatches $\mathbf{12}a_{hex}$ shown in FIG. 1 and hexagonal hatches $\mathbf{12}b_{hex}$ shown in FIG. 2 and are not "similar" in the strict geometric sense, but nevertheless are alike as having what is styled herein a "rectanguloid" shape, akin to an approximate rectangle which has had two adjacent corners beveled or chamfered.

Hexagonal hatch $\mathbf{12}a_{hex}$ and hexagonal hatch $\mathbf{12}b_{hex}$ are each a symmetrical hexagonal aperture having a double-right-angle-interposed side, a positively beveled side and a negatively beveled side. For each symmetrical hexagonal aperture: Two sides are situated in the columnwise direction, approximately parallel and having approximately the same length; two sides are situated in the rowwise direction, approximately parallel and having different lengths; and, two sides are each situated in an oblique direction, having approximately the same length and being disposed at approximately equal and opposite angles with respect to the rectangular array's rowwise (horizontal) direction.

Figure 1A:
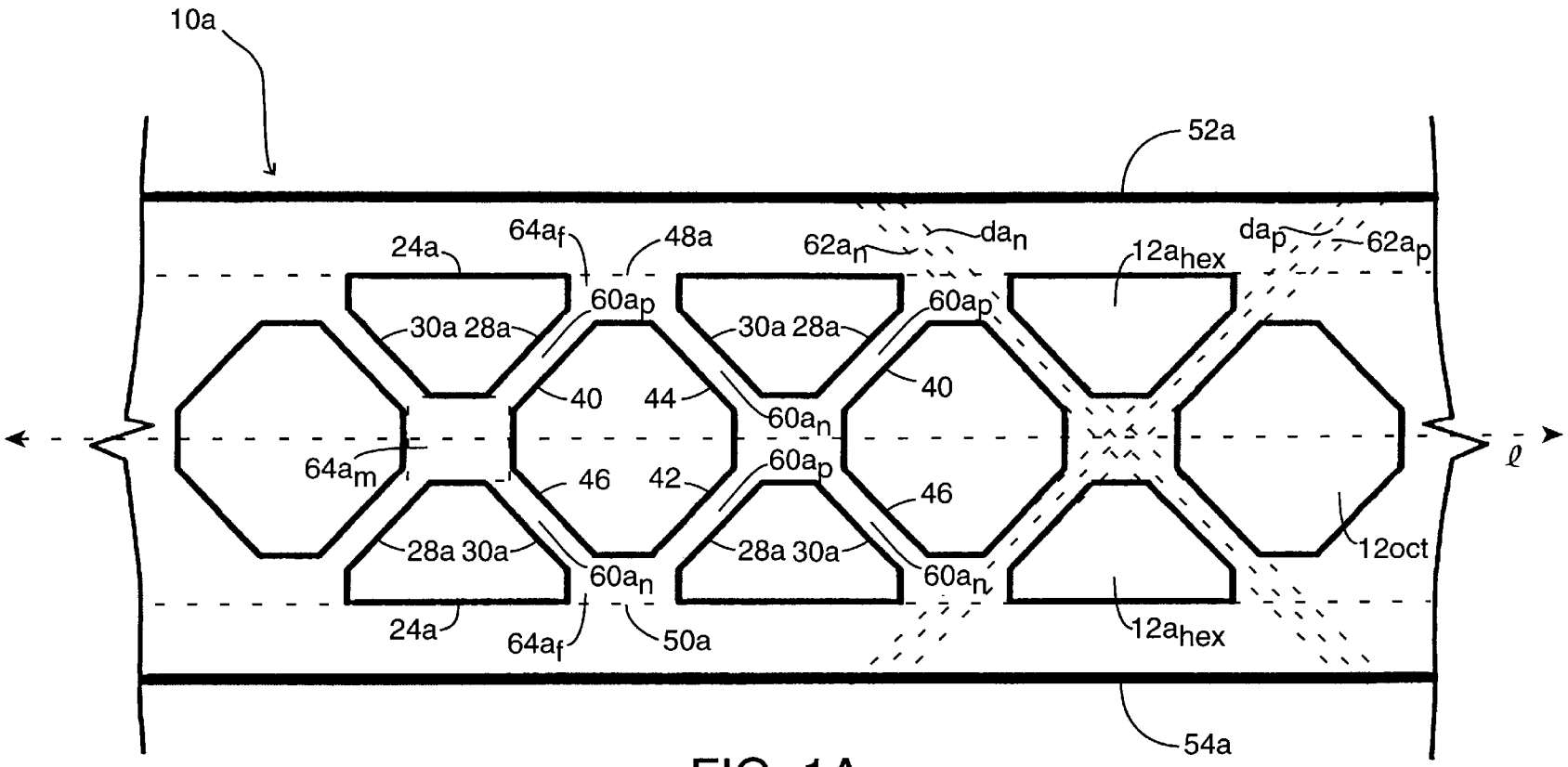
FIG. 1A is the view of the inventive deck embodiment as shown in FIG. 1, additionally showing some imaginary delineations.
Figure 2A:
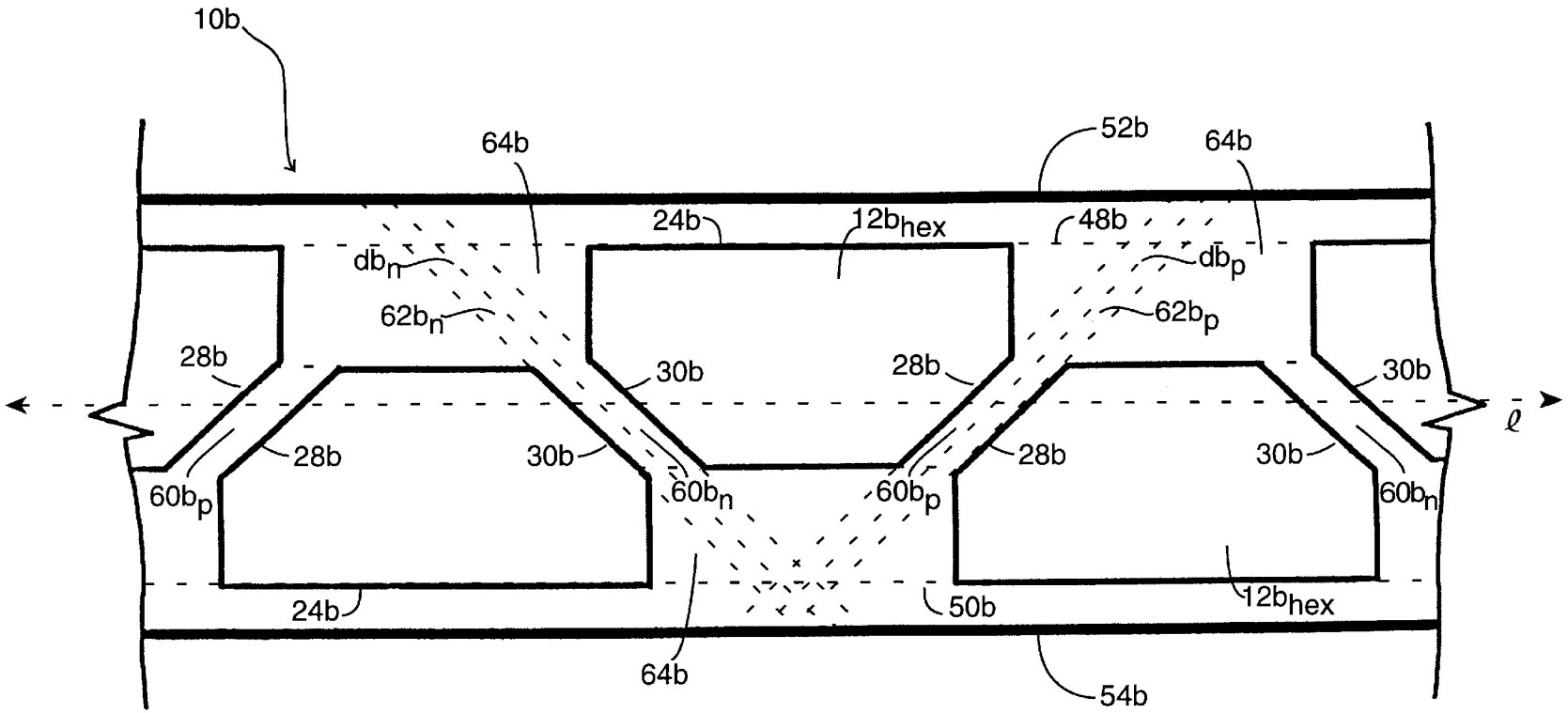
FIG. 2A is the view of the inventive deck embodiment as shown in FIG. 2, additionally showing some imaginary delineations.

Referring to FIG. 1A and FIG. 2A, each row of horizontal apertures has its hexagonal apertures approximately equivalently situated so that their double-right-angle-interposed sides face outward (away from the interior of the array), thereby approximately defining linear horizontal upper and lower borders (illustrated by dashed lines) of the respective arrays. The longer rowwise hexagonal sides 24*a* of first row $\mathbf{16}a_1$, define imaginary upper border 48*a* of array 14*a*. The longer rowwise hexagonal sides 24*a* of third row $\mathbf{16}a_3$ define imaginary lower border 50*a* of array 14*a*. The longer rowwise hexagonal sides 24*b* of first row $\mathbf{16}b_1$ define imaginary upper border 48*b* of array 14*b*. The longer rowwise hexagonal sides 24*b* of second row $\mathbf{16}b_2$ define imaginary lower border 50*b* of array 14*b*.

Typically, at least part of a ship deck's perimeter is approximately coextensive with the ship hull; i.e., to some extent at least, the deck is approximately bounded along its periphery by the hull. Hence, for purposes of envisioning the deck in the context of a ship, the port side (left-hand side of ship as ship faces forward) edge 52*a* and starboard side (right-hand side of ship as is ship faces forward) edge 54*a* of deck 10*a* shown in FIG. 1, and the port side edge 52*b* and starboard side edge 54*b* of deck 10*b* shown in FIG. 2, may be considered as being approximately coincident with the lateral periphery (i.e., port side and starboard side, respectively) of the ship.

Imaginary upper border 48*a* of array 14*a* is near and approximately parallel to port edge 52*a* of deck 10*a* . Imaginary lower border 50*a* of array 14*a* is near and approximately parallel to starboard edge 54*a* of deck 10*a*. Imaginary upper border 48*b* of array 14*b* is near and approximately parallel to port edge 52*b* of deck 10*b*. Imaginary lower border 50*b* of array 14*b* is near and approximately parallel to starboard edge 54*b* of deck 10*b*.

Thus considering decks 10*a* and 10*b*, it is seen that the ship has an imaginary longitudinal (running fore and aft) axis of symmetry, shown in FIG. 1A and FIG. 2A as dashed line l, which is approximately midway between: port edge 52*a* and starboard edge 54*a* of deck 10*a* shown in FIG. 1A; imaginary upper border 48*a* and imaginary lower border 50*a* shown in FIG. 1A; port edge 52*b* and starboard edge 54*b* of deck 10*b* shown in FIG. 2A; imaginary upper border 48*b* and imaginary lower border 50*b* shown in FIG. 2A.

Longitudinal axis l rowwise bisects array 12*a* in FIG. 1A, and rowwise bisects array 12*b* in FIG. 2A. In FIG. 1A, row $\mathbf{16}a_1$ of octagonal hatches $\mathbf{12}_{oct}$ is likewise rowwise bisected by longitudinal axis l. In FIG. 2A, longitudinal axis l passes rowwise through the hexagonal hatches $\mathbf{12}b_{hex}$ of both first row $\mathbf{16}b_1$ and second row $\mathbf{16}b_2$.

At many locations, an oblique side of an opening faces an oblique side of a diagonally adjacent opening, thereby forming an interfacial portion ("interface") of the approximately planar structure. With regard to the hatches shown in FIG. 1A, each hexagonal hatch $\mathbf{1}a_{hex}$ has at least one oblique side 28*a* or 30*a* which is approximately parallel to and forms an "interface" (either a positive interface $\mathbf{60}a_p$ or a negative interface $\mathbf{60}a_n$) with an octagonal oblique side 40, 42, 44 or 46 of an adjacent octagonal hatch $\mathbf{12}_{oct}$ which is in a next row 16*a* and a next column 18*a*. Every interface is oblique in either a selected positive direction (positive interface $\mathbf{60}a_p$) or a selected negative direction (negative interface $\mathbf{60}a_n$).

With regard to the hatches shown in FIG. 2A, each hexagonal hatch $\mathbf{12}b_{hex}$ has at least one hexagonal oblique side 28*b* or 30*b* which is approximately parallel to and forms an "interface" (either a positive interface $\mathbf{60}b_p$ or a negative interface $\mathbf{60}b_n$) with a hexagonal oblique side 28*b* or 30*b* of an adjacent hexagonal hatch $\mathbf{12}b_{hex}$ which is in a next row 16*b* and a next column 18*b*; such an interface is shown to be formed by a hexagonal oblique side 28*b* with a hexagonal oblique side 28*b*, or by a hexagonal oblique side 30*b* with a hexagonal oblique side 30*b*. Every interface is oblique in either a selected positive direction (positive interface $\mathbf{60}b_p$ or a selected negative direction (negative interface $\mathbf{60}b_n$).

Figure 1B:
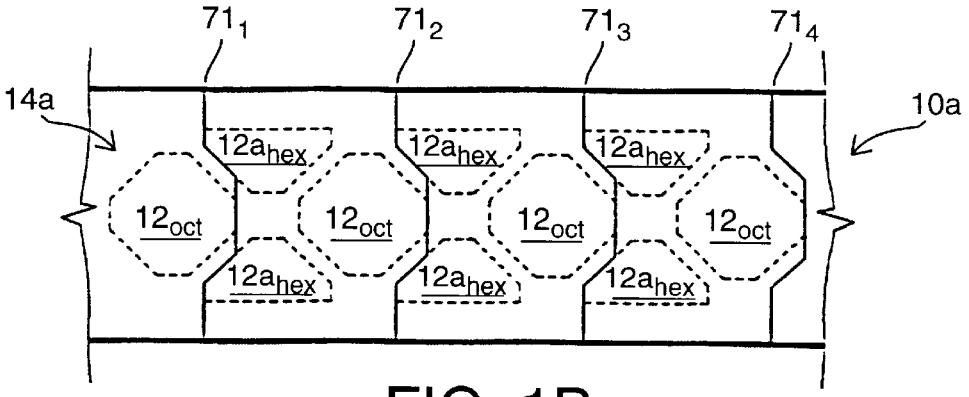
FIG. 1B is the view of the inventive deck embodiment as shown in FIG. 1, additionally showing an inventive embodiment of a distribution of bulkheads.

The terms "positive direction" and "negative direction" are intended herein to refer to angles of orientation with respect to longitudinal axis l, wherein longitudinal axis l is designated the "x axis" analogue in an "x-y" Cartesian plane; hence, of the hatches shown in FIG. 1A and in FIG. 1B, in each figure approximately half of the oblique sides are positively directed (i.e., positively "sloped" in terms of deviation from longitudinal axis l) and approximately half of the oblique sides are negatively directed (i.e., negatively "sloped" in terms of deviation from longitudinal axis l).

Certain properties become manifest due to inherent symmetrical and geometrical aspects of each of array 14*a* and array 14*b*. Every interface is formed by a pair of abutting, approximately parallel oblique sides. The two abutting oblique sides and the interface formed thereby each define approximately the same positive or negative slope. In FIG. 1A, interfaces $\mathbf{60}a_p$ (positively sloped) and $\mathbf{60}a_n$ (negatively sloped) are aligned with each other, end-to-end approximately colinearly, in approximately the same positive and negative diagonal directions, as indicated by imaginary dashed diagonal lines $da_p$ and $da_n$, respectively. Similarly, in FIG. 2A, interfaces $\mathbf{60}b_p$ (positively sloped) and $\mathbf{60}b_n$ (negatively sloped) are aligned with each other, end-to-end approximately colinearly, in approximately the same positive and negative diagonal directions, as indicated by imaginary dashed diagonal lines $db_p$ and $db_n$, respectively.

In other words, in FIG. 1A, two positively sloped interfaces $\mathbf{60}a_p$, when considered as connected end-to-end, medially define a positively sloped diagonal line $da_p$; two negatively sloped interfaces $\mathbf{60}a_n$, when considered as connected end-to-end, medially define a negatively sloped diagonal line $da_n$. In FIG. 2A, each positively sloped interface $\mathbf{60}b_p$ medially defines a positively sloped diagonal line $db_p$; each negatively sloped interfaces $\mathbf{60}b_n$ medially defines a negatively sloped diagonal line $db_n$.

Moreover, two positively sloped interfaces $\mathbf{60}a_p$, when considered as connected end-to-end, laterally peripherally define a positively sloped continuous rectilinear portion $\mathbf{62}a_p$ (for example as indicated in FIG. 1A by a dashed border); two negatively sloped interfaces $\mathbf{60}a_n$, when considered as connected end-to-end, laterally peripherally define a negatively sloped continuous rectilinear portion $\mathbf{62}a_n$(for example as indicated in FIG. 1A by a dashed border). One positively sloped interface $\mathbf{60}b_p$ laterally peripherally defines a positively sloped continuous rectilinear portion $\mathbf{62}b_p$ (for example as indicated in FIG. 2A by a dashed border); one negatively sloped interface $\mathbf{60}b_n$laterally peripherally defines a negatively sloped continuous rectilinear portion $\mathbf{62}b_n$ (for example as indicated in FIG. 2A by a dashed border).

The interfaces $\mathbf{60}a_p$ and $\mathbf{60}a_n$ thereby approximately define in FIG. 1A a "crisscross" of diagonal, linear, continuous portions $\mathbf{62}a_p$ and $\mathbf{62}a_n$ of structure 10*a*; continuous portions $\mathbf{62}a_p$ and $\mathbf{62}a_n$ traverse array 14*a*. Similarly, the interfaces $\mathbf{60}b_p$ and $\mathbf{60}b_n$ thereby approximately define in FIG. 2A a "crisscross" of diagonal, linear, continuous portions $\mathbf{62}b_p$ and $\mathbf{62}b_n$ of structure 10*b*; continuous portions $\mathbf{62}b_p$ and $\mathbf{62}b_n$ traverse array 14*b*.

In FIG. 1A, each continuous portion $\mathbf{62}a_p$ includes two interfaces $\mathbf{60}a_p$; each continuous portion $\mathbf{62}a_n$ includes two interfaces $\mathbf{60}a_n$In FIG. 2A, each continuous portion $\mathbf{62}b_p$ includes one interface $\mathbf{60}b_p$; each continuous portion $\mathbf{62}b_n$ includes one interface $\mathbf{60}b_n$.

In FIG. 1A, since upper border 48*a* and lower border 50*a* of array 14*a* are proximately parallel to starboard edge 52*a* and port edge 54*a*, respectively, of deck 10*a*, continuous portions $\mathbf{62}a_p$ and $\mathbf{62}a_n$ can be considered to traverse or substantially traverse deck 10*a*. Similarly, in FIG. 2A, since upper border 48*b* and lower border 50*b* of array 14*b* are proximately parallel to starboard edge 52*b* and port edge 54*b*, respectively, of deck 10*b*, continuous portions $\mathbf{62}b_p$ and $\mathbf{62}b_n$ can be considered to traverse or substantially traverse deck 10*b*.

Hence, in FIG. 1A, every continuous portion $\mathbf{62}a_p$ , every diagonal line $da_p$, every interface $\mathbf{60}a_p$, every oblique hexagonal side 28*a*, every oblique octagonal side 40 and every oblique octagonal side 42 defines approximately the same positive slope; every continuous portion $\mathbf{62}a_n$, every diagonal line $da_n$, every interface $\mathbf{60}a_n$, every oblique hexagonal side 30*a*, every oblique octagonal side 44 and every oblique octagonal side 46 defines approximately the same negative slope. Thus, all positively sloped diagonal lines $da_p$ are approximately parallel to each other; all negatively sloped diagonal lines $daa_n$ are approximately parallel to each other.

Similarly, in FIG. 2A, every continuous portion 62$b_p$, every diagonal line $ddb_p$, every interface 60$b_p$, and every oblique hexagonal side 28*b* defines approximately the same positive slope; every continuous portion 62$b_n$, every diagonal line $ddb_n$, every interface 60$b_n$ and every oblique hexagonal side 30*b* defines approximately the same negative slope. Thus, all positively sloped diagonal lines $ddb_p$ are approximately parallel to each other; all negatively sloped diagonal lines $dd_{bn}$ are approximately parallel to each other.

Furthermore, in FIG. 1A, the absolute value of the positive slope defined by continuous portions 62$a_p$, diagonal lines $da_p$, interfaces 60$a_p$, oblique hexagonal sides 28*a*, octagonal oblique sides 40 and oblique octagonal sides 42 is approximately equal to the absolute value of the negative slope defined by continuous portions 62$a_n$, diagonal lines $da_n$, interfaces 60$a_n$, oblique hexagonal sides 30*a*, octagonal oblique sides 44 and oblique octagonal sides 46. Similarly, in FIG. 2A, the absolute value of the positive slope defined by continuous portions 62*b*, diagonal lines $db_p$, interfaces 60*b* and oblique hexagonal sides 28*b* is approximately equal to the absolute value of the negative slope defined by continuous portions 62$b_n$, diagonal lines $ddb_n$, interfaces 60$b_n$ and oblique hexagonal sides 30*b*.

In FIG. 1A and FIG. 1B, the slope (degree of deviation from longitudinal axis l) of each of diagonal lines $da_p$, $da_n$, $db_p$ and $db_n$ is represented to be roughly 45°; hence, diagonal lines $da_p$ are approximately perpendicular with respect to diagonal lines $da_n$, and diagonal lines $db_p$ are approximately perpendicular with respect to diagonal lines $db_n$.

It should be apparent to the ordinarily skilled artisan reading this disclosure that, in accordance with inventive principles, so long as the slope of each of diagonal lines $da_p$ in array 14*a* is approximately equal, the slope of each of diagonal lines $da_n$ in array 14*a* is approximately equal, the slope of each of diagonal lines $db_p$ in array 14*b* is approximately equal, and the slope of each of diagonal lines $db_n$ in array 14*b* is approximately equal: The basic geometric integrity of array 14*a* can be retained while varying one or both of the slopes of diagonal lines $da_p$ and $da_n$; the basic geometric integrity of array 14*b* can be retained while varying one or both of the slopes of diagonal lines $db_p$ and $db_n$; in array 14*a*, the absolute value of the slope of diagonal lines $da_p$ need not equal the absolute value of the slope of diagonal lines $da_n$; in array 14*b*, the absolute value of the slope of diagonal lines $db_p$ need not equal the absolute value of the slope of diagonal lines $db_n$.

Notable are certain shared attributes of array 14*a* and array 14*b* which are more generally characteristic of the present invention. Reference is still being made to FIG. 1A and FIG. 2A, wherein may be used more generic designations such as follows: approximately planar structure 10 (for deck 10*a* or deck 10*b*); geometric opening 12 (for hexagonal hatch 12$a_{hex}$, octagonal hatch 12$_{oct}$ or hexagonal hatch 12$b_{hex}$); rectangular array 14 (for rectangular array 14*a* or rectangular array 14*b*); horizontal row 16 (for horizontal row 16*a* or horizontal row 16*b*); vertical column 18 (for vertical column 18*a* or vertical column 18*b*); interface 60 (for interface 60*a* or interface 60*b*); continuous portion 62 (for continuous portion 62*a* or continuous portion 62*b*).

In accordance with most embodiments of this invention, approximately planar structure 10 has a plurality of geometric openings 12 in a rectangular array 14 of at least two horizontal rows 16 and at least two vertical columns 18. Each geometric opening 12 has at least one oblique side which is approximately parallel to and forms an interface 60 with an oblique side of an adjacent geometric opening 12 which is in a next row 16 and a next column 18. Every interface 60 is oblique in either of a selected positive direction and a selected negative direction. The interfaces 60 are approximately aligned so as to approximately define a diagonal crisscross of continuous portions 62 of structure 10 which traverse array 14. Each continuous portion 62 includes at least one interface 60.

Other properties are seen to be generally true of inventive arrays 14 such as array 14*a* and array 14*b*. The rows 16 define rectilinear horizontal sections which are not discrete with respect to each other. Similarly, the columns 18 define rectilinear vertical sections which are not discrete with respect to each other. Rather, there is partial "overlap" between adjacent rows 16 and between adjacent columns 18. This inventive feature entails sufficient propinquity of each pair of adjacent oblique sides which form an interface 60, thereby assuring both (i) a relatively large total open area in structure 10 and (ii) a distinct cross-diagonal pattern of continuous portions 62 in structure 10.

Moreover, each intersection of a row 16 with a column 18 defines a common structural area of structure 10. Each intersection of first row 16$a_1$ or third row 16$a_3$ with a column 18*a* defines an approximately rectangular flanking platform 64$a_f$ which approximately coincides with a segment of upper border 48*a* or lower border 50*a*. Each intersection of second row 16$a_2$ with a column 18*a* defines an approximately rectangular medial platform 64$a_m$. Each intersection of first row 16$b_1$ or second row 16$b_2$ with a column 18*b* defines an approximately rectangular flanking platform 64*b* which approximately coincides with a segment of upper border 48*b* or lower border 50*b*. It is also noted that, in array 14*a* and especially in array 14*b*, each non-flanking (interior) vertex of a platform 64 is nearly coincident with a non-flanking vertex of the defining columnwise side of an opening 12. Looking at it another way, in array 14*a*, the opening 12$a_{oct}$ vertices which join oblique sides 40, 42, 44 and 46 with columnwise sides 32 and 34 are nearly in alignment, in a rowwise direction, with the opening 12$a_{hex}$ shorter rowwise sides 26*a*; in array 14*b*, the opening 12$b_{hex}$ vertices which join oblique sides 28*b* and 30*b* with columnwise sides 20*b* and 22*b* are nearly in alignment, in a rowwise direction, with the opening 12$b_{hex}$ shorter rowwise sides 26*b*.

It is emphasized that inventive practice is not limited to array 14*a* shown in FIG. 1 and array 14*b* shown in FIG. 2; nor is this invention limited to variations of array 14*a* and array 14*b*. In the light of this disclosure, the ordinarily skilled artisan should readily appreciate the application of inventive principles to various patterns of inventive arrays 14 which are markedly distinguishible from arrays 14*a* and 14*b* in one or more respects. For example, this invention admits of effectuation not only for hexagonal apertures and octogonal apertures but for a diversity of apertural shapes, e.g., rectilinear, curvilinear, or having indicia of both rectilinearity and curvilinearity.

To elaborate, it is seen that there are multifarious inventively "thematic" patterns of apertural arrays. Inventive apertural arrayal motifs can be manifested in terms of rowwise arrangement, columnwise arrangement, diagonal arrangement, type or types of apertural shapes, interrelationships among various apertural shapes, etc. Among the configurational parameters which can be varied by the inventive practitioner are one or more of the following: (i) the number of different types of apertural shapes; (ii) the characteristics of each type of apertural shape; (iii) the relative distribution of the apertural shapes; (iv) the number of rows of apertural shapes; (v) the number of columns of apertural shapes; (vi) the degree of obliqueness of the positively sloped diagonals; (vii) the degree of obliqueness of the negatively sloped diagonals.

The openings, according to this invention, can be characterized by rectilinearity, or curvilinearity or both rectilinearity and curvilinearity. For example, an inventive opening can be entirely rectilinear and hence polygonal, i.e., thus defining a closed plane figure bounded by three or more line segments, i.e., wherein three or more line segments are joined end-to-end; hexagons and octagons, for instance, are types of polygons. Or, an inventive opening can be partially rectilinear and partially curvilinear, e.g., substantially define a polygonal figure but have curvature at certain locations around the perimeter of the opening, such as at the vertices or corners where adjacent sides meet. Or, an inventive opening can be entirely curvilinear, e.g., generally define a polygonal figure but have varying degrees of curvature around the entire perimeter of the opening.

Figure 4:
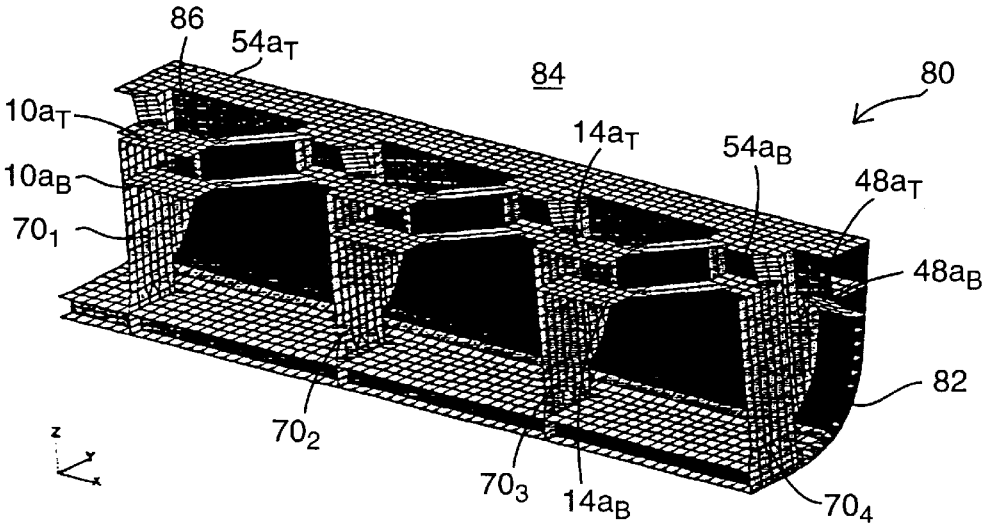
FIG. 4 is a view, similar to the view shown in FIG. 3, of the inventive ship embodiment shown in FIG. 3, here shown port side looking aft.
Figure 3:
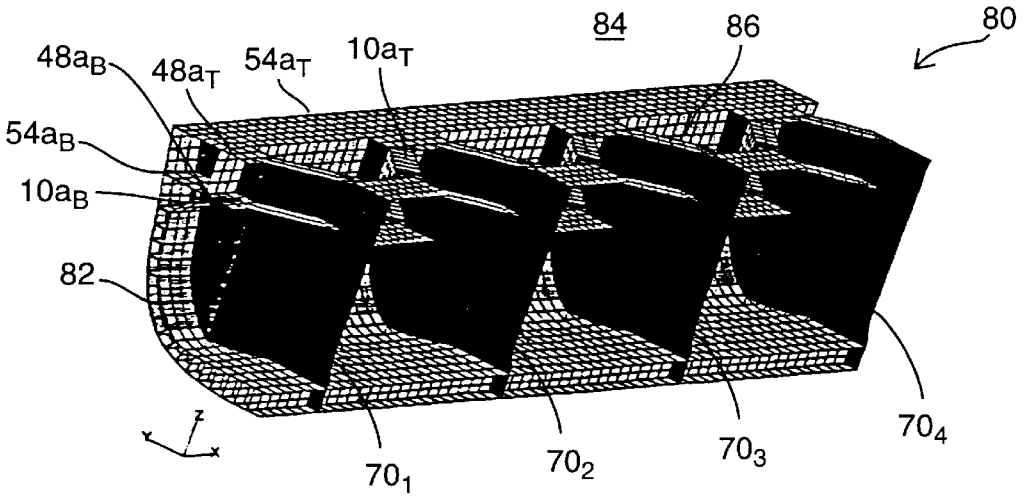
FIG. 3 is a partial sectional perspective view of an inventive ship embodiment, shown port side looking forward, wherein the ship comprises an inventive deck embodiment and an inventive bulkhead embodiment such as shown in FIG. 1B.

Reference now being made to FIG. 1B, FIG. 3 and FIG. 4, approximately vertical transverse bulkheads can be inventively provided along continuous, generally crosswise paths which circumvent one or more apertured areas of the deck. For example, transverse bulkheads, such as bulkheads $\mathbf{70}_1$, $\mathbf{70}_2$, $\mathbf{70}_3$ and $\mathbf{7}_4$ shown in FIG. 3 and FIG. 4, can be accommodated by following staggered paths, such as the respectively corresponding paths $\mathbf{71}_1$, $\mathbf{71}_2$, $\mathbf{71}_3$ and $\mathbf{71}_4$ shown in FIG. 1B.

FIG. 3 and FIG. 4 reveal cutaway perspectives of approximately half of ship 80, including the layout of an interior deck space. Ship 80 includes ship hull 82 and two decks, viz., top level deck $\mathbf{10}a_T$ and bottom level deck $\mathbf{10}a_B$. Top deck $\mathbf{10}a_T$ has array $\mathbf{14}a_T$ of hexagonal hatches $\mathbf{12}a_{hex\text{-}T}$ and octagonal hatches $\mathbf{12}_{oct\text{-}T}$; bottom deck $\mathbf{10}a_B$ has array $\mathbf{14}a_B$ of hexagonal hatches $\mathbf{12}a_{hex\text{-}B}$ and octagonal hatches $\mathbf{12}_{oct\text{-}B}$.

Port edge $\mathbf{54}a_T$ of top deck $\mathbf{10}a_T$ is shown to meet ship hull 82 at the hull's port side 84; similarly, port edge $\mathbf{54}a_B$ of bottom deck $\mathbf{10}a_B$ is shown to meet ship hull 82 at the hull's port side 84. It can be envisioned that starboard edge $\mathbf{52}a_T$ of top deck $\mathbf{10}a_T$ meets ship hull 82 at the hull's starboard side (not shown), and that starboard edge $\mathbf{52}a_B$ of bottom deck $\mathbf{10}a_B$ meets ship hull 82 at the hull's starboard side (not shown).

Each of transverse bulkheads $\mathbf{70}_1$, $\mathbf{70}_2$, $\mathbf{70}_3$ and $\mathbf{70}_4$ crosses each of decks $\mathbf{10}a_T$ and $\mathbf{10}a_B$ so as to partially bound three hatches in each deck. In relation to top deck $\mathbf{10}a_T$, each transverse bulkhead borders upon part of each of two hexagonal hatches $\mathbf{12}a_{hex\text{-}T}$ and part of one octagonal hatch $\mathbf{12}_{oct\text{-}T}$. Similarly, in relation to bottom deck $\mathbf{10}a_B$, each transverse bulkhead borders upon part of each of two hexagonal hatches $\mathbf{12}a_{hex\text{-}B}$ and part of one octagonal hatch $\mathbf{12}_{oct\text{-}B}$.

As perhaps best illustrated in FIG. 1B, transverse bulkheads $\mathbf{70}_1$, $\mathbf{70}_2$, $\mathbf{70}_3$ and $\mathbf{70}_4$ cross decks $\mathbf{10}a_B$ and $\mathbf{10}a_B$ so as to appear "recessed" or "indented" in the fore direction of ship 80. A "mirror-image" inventive embodiment can be readily envisioned wherein transverse bulkheads $\mathbf{70}_1$, $\mathbf{70}_2$, $\mathbf{70}_3$ and $\mathbf{70}_4$ are shown to cross each of decks $\mathbf{10}a_T$ and $\mathbf{10}a_B$ so as to appear "recessed" or "indented" in the aft direction of ship 80; mentally reversing the port and starboard sides of ship 80 shown in FIG. 3 and FIG. 4, for example, could achieve such a "mirror-image" visualization. The inventive possibilities are endless for arranging and configuring bulkheads in conformity with inventive apertural arrayal. Generally speaking, for inventive marine vessel embodiments wherein bulkheads are implemented, at least one bulkhead at least partially crosses each deck so as not to encroach upon any apertures. The bulkhead will circumvent any aperture which is in the vicinity of the bulkhead. Although the bulkheads are shown in FIG. 1B, FIG. 3 and FIG. 4 to partially bound at least one hatch in each deck, in inventive practice a bulkhead need not be contiguous with one or more apertures or portions thereof. The inventive requirement in this regard is that each bulkhead avoid or skirt the openings so as not to impinge on any opening.

As shown in FIG. 3 and FIG. 4, a portion of top deck's array $\mathbf{14}a_T$ matches a portion of bottom deck's array $\mathbf{14}a_B$ whereby hexagonal hatches $\mathbf{12}a_{hex\text{-}T}$ are in approximate vertical alignment with hexagonal hatches $\mathbf{12}a_{hex\text{-}B}$ and octagonal hatches $\mathbf{12}_{oct\text{-}T}$ are in approximate vertical alignment with octagonal hatches $\mathbf{12}_{oct\text{-}B}$. In other words, at least to some extent, array $\mathbf{14}a_T$ is approximately "correlative" with array $\mathbf{14}a_B$. A section of array $\mathbf{14}a_T$ is shown to be congruous with a section of array $\mathbf{14}a_B$. Depending on the inventive marine vessel embodiment, two or more different (e.g., successive) decks can be entirely or partially correlative in that one, some or all of the apertures of one deck are in approximate vertical alignment with one, some or all of the apertures of one or more other decks.

Approximately vertical longitudinal port side bulkhead 86 is shown provided along port side 84, between decks $\mathbf{10}a_T$ and $\mathbf{10}a_B$, so as to approximately join upper border $\mathbf{48}a_T$ of array $\mathbf{14}a_T$ with upper border $\mathbf{48}a_B$ of array $\mathbf{14}a_B$. Another longitudinal bulkhead, the starboard side counterpart (not shown), can be envisioned as disposed between decks $\mathbf{10}a_T$ and $\mathbf{10}a_B$ so as to approximately join lower border $\mathbf{50}a_T$ of array $\mathbf{14}a_T$ with lower border $\mathbf{50}a_B$ of array $\mathbf{14}a_B$. Some inventive marine vessel embodiments feature longitudinal bulkheads, such as depicted in FIG. 3 and FIG. 4, on each of the port and starboard sides. Such longitudinal bulkheads, which approximately coincide with the upper and lower arrayal borders of each of correlative plural decks, afford a "double hull" type of structural reinforcement, which is especially propitious where disposed in the vicinities of populated deck areas.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. An approximately planar structure having a plurality of geometric openings in a rectangular array of at least two rows and at least two columns, each said geometric opening having at least one oblique side which is approximately parallel to and forms an interface with an oblique side of an adjacent said geometric opening which is in a next said row and a next said column, wherein:

every said interface is oblique in either of a selected positive direction and a selected negative direction;

every said opening is a hexagonal opening;

said array has a first said row and a second said row;

said first row has a plurality of said hexagonal openings;

said second row has a plurality of said hexagonal openings;

every said column has a said hexagonal opening;

said hexagonal openings are approximately congruent;

every said hexagonal opening is a rectanguloid which has a pair of approximately parallel approximately equal columnwise sides, a pair of approximately parallel unequal rowwise sides, and a pair of said oblique sides adjoining the ends of the shorter said rowwise side;

for every said hexagonal opening, said longer said rowwise side faces outwardly with respect to said array;

every said hexagonal opening in said first row is oriented approximately equally;

every said hexagonal opening in said second row is oriented approximately equally and approximately invertedly with respect to said hexagonal openings in said first row.

2. An approximately planar structure as in claim 1, wherein said interfaces are approximately aligned so as to approximately define a diagonal crisscross of continuous portions of said structure which traverse said array, each said continuous portion including at least one said interface.

3. An approximately planar structure as in claim 2, wherein each said continuous portion at least substantially traverses said structure.

4. An approximately planar structure having a plurality of geometric openings in a rectangular array of at least two rows and at least two columns, each said geometric opening having at lest one oblique side which is approximately parallel to and forms an interface with an oblique side of an adjacent said geometric opening which is in a next said row and a next said column, wherein:

every said interface is oblique in either of a selected positive direction and a selected negative direction;

said array has a first outer said row, a second outer said row and an intermediate said row;

every said opening in said first outer said row and said second outer said row is a hexagonal opening;

every said opening in said intermediate said row is an octagonal opening;

said first outer said row has a plurality of said hexagonal openings;

said second outer said row has a plurality of said hexagonal openings;

said intermediate said row has a plurality of said octagonal openings;

said hexagonal openings are approximately congruent;

said octagonal openings are approximately congruent;

said columns alternate between having two said hexagonal openings and having one said octagonal opening;

every said hexagonal opening is a rectanguloid which has a pair of approximately parallel approximately equal columnwise hexagonal sides, a pair of approximately parallel unequal rowwise hexagonal sides, and a pair of hexagonal said oblique sides adjoining the ends of the shorter said rowwise hexagonal side;

every said octagonal opening has a pair of approximately parallel approximately equal columnwise octagonal sides, a pair of approximately parallel approximately equal rowwise octagonal sides, and two pairs of octagonal said oblique sides, each said octagonal said oblique side adjoining an end of a said columnwise octagonal side and an end of a said rowwise octagonal side;

for every said hexagonal opening, said longer said rowwise hexagonal side faces outwardly with respect to said array;

every said hexagonal opening in said first outer said row is oriented approximately equally;

every said octagonal opening in said intermediate said row is oriented approximately equally;

every said hexagonal opening in said second outer said row is oriented approximately equally and approximately invertedly with respect to said hexagonal openings in said first outer said ad row.

5. An approximately planar structure as in claim 4, wherein said interfaces are approximately aligned so as to approximately define a diagonal crisscross of continuous portions of said structure which traverse said array, each said continuous portion including at least one said interface.

6. An approximately planar structure as in claim 5, wherein each said continuous portion at least substantially traverses said structure.

7. A marine vessel comprising at least one deck having a plurality of hatches in a rectangular array of at least two longitudinal rows and at least two transverse columns, each said hatch having at least one oblique side which is approximately parallel to and forms an interface with an oblique side of an adjacent said hatch which is in a next said row and a next said column, wherein every said interface is oblique in either of a selected positive direction and a selected negative direction.

8. A marine vessel as in claim 7, wherein said interfaces are approximately aligned so as to approximately define a diagonal crisscross of continuous portions of said deck which traverse said array, each said continuous portion including at least one said interface.

9. A marine vessel as in claim 8, wherein each said continuous portion at least substantially traverses said deck.

10. A marine vessel as in claim 8, wherein at least one said hatch is a hexagonal hatch.

11. A marine vessel as in claim 10, wherein:

every said hatch is a hexagonal hatch;

said array has a first said row and a second said row;

said first row has a plurality of said hexagonal hatches;

said second row has a plurality of said hexagonal hatches;

every said column has a said hexagonal hatch;

said hexagonal hatches are approximately congruent;

every said hexagonal hatch is a rectanguloid which has a pair of approximately parallel approximately equal columnwise sides, a pair of approximately parallel unequal rowwise sides, and a pair of said oblique sides adjoining the ends of the shorter said rowwise side;

for every said hexagonal hatch, said longer said rowwise side faces outwardly with respect to said array;

every said hexagonal hatch in said first row is oriented approximately equally;

every said hexagonal hatch in said second row is oriented approximately equally and approximately invertedly with respect to said hexagonal hatches in said first row.

12. A marine vessel as in claim 10, wherein:

said array has a first outer said row, a second outer said row and an intermediate said row;

every said hatch in said first outer said row and said second outer said row is a hexagonal hatch;

every said hatch in said intermediate said row is an octagonal hatch;

said first outer said row has a plurality of said hexagonal hatches;

said second outer said row has a plurality of said hexagonal hatches;

said intermediate said row has a plurality of said octagonal hatches;

said hexagonal hatches are approximately congruent;

said octagonal hatches are approximately congruent;

said columns alternate between having two said hexagonal hatches and having one said octagonal hatch;

every said hexagonal hatch is a rectanguloid which has a pair of approximately parallel approximately equal columnwise hexagonal sides, a pair of approximately parallel unequal rowwise hexagonal sides, and a pair of hexagonal said oblique sides adjoining the ends of the shorter said rowwise hexagonal side;

every said octagonal hatch has a pair of approximately parallel approximately equal columnwise octagonal sides, a pair of approximately parallel approximately equal rowwise octagonal sides, and two pairs of octagonal said oblique sides, each said octagonal said oblique side adjoining an end of a said columnwise octagonal side and an end of a said rowwise octagonal side;

for every said hexagonal hatch, said longer said rowwise hexagonal side faces outwardly with respect to said array;

every said hexagonal hatch in said first outer said row is oriented approximately equally;

every said octagonal hatch in said intermediate said row is oriented approximately equally;

every said hexagonal hatch in said second outer said row is oriented approximately equally and approximately invertedly with respect to said hexagonal hatches in said first outer said row.

13. A marine vessel as in claim 7, comprising at least one bulkhead which at least partially crosses a said deck so as not to encroach upon any said hatch.

14. A marine vessel as in claim 7, comprising at least two said decks, every said deck having the same plurality of hatches in an approximately congruent rectangular array, every said rectangular array being in approximate correlation in an approximately vertical direction.

15. A marine vessel as in claim 14, comprising at least one bulkhead which at least partially crosses each said deck so as not to encroach upon any said hatch in any said deck.

16. A plural-level structure comprising at least one partition which approximately defines a horizontal plane for separating two vertically consecutive said levels of said plural-level structure, said partition being provided with at least five approximately congruent hexagonal apertures for permitting communication between said two separated levels, wherein:

each said hexagonal aperture has:

a pair of approximately parallel unequal longitudinal sides, said longitudinal sides being a longer longitudinal side and a shorter longitudinal side;

a pair of approximately parallel approximately equal transverse sides;

a positively diagonal side; and a negatively diagonal side; and the arrangement of said hexagonal apertures is characterized by:

two longitudinal apertural alignments, each said longitudinal apertural alignments having at least two said hexagonal apertures whereby the longer said longitudinal sides are approximately equal and are approximately colinear, and whereby the shorter said longitudinal sides are approximately equal and are approximately colinear;

at least two positively diagonal apertural alignments, each said positively diagonal apertural alignment having two said hexagonal apertures whereby two said negatively diagonal sides are adjacent and approximately parallel; and at least two negatively diagonal apertural alignments, each said negatively diagonal apertural alignment having two said hexagonal apertures whereby two said positively diagonal sides are adjacent and approximately parallel.

17. A plural-level structure as in claim 16 wherein, for each said hexagonal aperture:

said positively diagonal side and said negatively diagonal side are approximately equal in length; and said positively diagonal side is oriented at approximately forty-five degrees with respect to each said longitudinal side and with respect to each said transverse side, and is oriented approximately orthogonally with respect to said negatively diagonal side.

18. A plural-level structure as in claim 16, wherein, for each said hexagonal aperture:

said positively diagonal side and said negatively diagonal side are unequal in length; and said positively diagonal side is oriented in the approximate range between thirty degrees and sixty degrees with respect to each said longitudinal side and with respect to each said transverse side; and said negatively diagonal side is oriented in the approximate range between thirty degrees and sixty degrees with respect to each said longitudinal side and with respect to each said transverse side.

19. A plural-level structure as in claim 16, comprising at least two consecutive said partitions for separating at least three vertically consecutive said levels of said plural-level structure, each said partition being approximately identically provided with at least five said hexagonal apertures for permitting communication between said at least three separated levels, said at least two consecutive partitions being configured whereby the corresponding said arrangements are approximately in vertical spatial alignment.

20. A plural-level structure as in claim 16, comprising at least one wall which engages at least one said partition, said wall at least substantially traversing said partition so as not to encroach upon any said hexagonal aperture.

21. A plural-level structure comprising at least one partition which approximately defines a horizontal plane for separating two vertically consecutive said levels of said plural-level structure, said partition being provided with, for permitting communication between said two separated levels, at least six approximately congruent hexagonal apertures and at least four approximately congruent octagonal apertures, wherein:

each said hexagonal aperture has:

a pair of approximately parallel unequal longitudinal hexagonal sides, said longitudinal hexagonal sides being a longer longitudinal side and a shorter longitudinal side;

a pair of approximately parallel approximately equal transverse hexagonal sides;

a positively diagonal hexagonal side; and a negatively diagonal hexagonal side;

each said octagonal aperture has:

a pair of approximately parallel longitudinal octagonal sides;

a pair of approximately parallel approximately equal transverse octagonal sides;

a pair of approximately parallel positively diagonal octagonal sides; and a pair of approximately parallel negatively diagonal octagonal sides; and the arrangement of said hexagonal apertures and said octagonal apertures is characterized by:

two longitudinal hexagonal apertural alignments, each said longitudinal hexagonal apertural alignment having at least three said hexagonal apertures whereby the longer said longitudinal hexagonal sides are approximately equal and are approximately colinear, and whereby the shorter said longitudinal hexagonal sides are approximately equal and are approximately colinear;

a longitudinal octagonal aperatural alignment, said longitudinal octagonal apertural alignment having at least four said octagonal apertures whereby are established two approximate colinearities, each approximate colinearity being of at least two said longitudinal octagonal sides, said longitudinal octagonal apertural alignment being situated between said two longitudinal hexagonal apertural alignments;

at least two positively diagonal apertural alignments, each said positively diagonal apertural alignment having two said hexagonal apertures and a said octagonal aperture, said octagonal aperture being between said two horizontal apertures, whereby are established two approximately parallel adjacencies, each said approximately parallel adjacency being of a said negatively diagonal hexagonal side and a said negatively diagonal octagonal side, and whereby are established two approximate colinearities, each said approximate colinearity being of a said positively diagonal hexagonal side and a said positively diagonal octagonal side; and at least two negatively diagonal apertural alignments, each said negatively diagonal apertural alignment having two said hexagonal apertures and a said octagonal aperture, said octagonal aperture being between said two horizontal apertures, whereby are established two approximately parallel adjacencies, each said approximately parallel adjacency being of a said positively diagonal hexagonal side and a said positively diagonal octagonal side, and whereby are established two approximate colinearities, each said approximate colinearity being of a said negatively diagonal hexagonal side and a said negatively diagonal octagonal side.

22. A plural-level structure as in claim 21, wherein:

for each said hexagonal aperture:

said positively diagonal hexagonal side and said negatively diagonal hexagonal side are approximately equal; and said positively diagonal hexagonal side is oriented at approximately forty-five degrees with respect to each said longitudinal hexagonal side and with respect to each said transverse hexagonal side, and is oriented approximately orthogonally with respect to said negatively diagonal hexagonal side; and for each said octagonal aperture:

said positively diagonal octagonal sides and said negatively diagonal octagonal sides are approximately equal; and each said positively diagonal octagonal side is oriented at approximately forty-five degrees with respect to each said longitudinal octagonal side and with respect to each said transverse octagonal side, and is oriented approximately orthogonally with respect to each said negatively diagonal octagonal side.

23. A plural-level structure as in claim 21, wherein:

for each said hexagonal aperture:

said positively diagonal hexagonal side and said negatively diagonal hexagonal side are unequal; and said positively diagonal hexagonal side is oriented in the approximate range between thirty degrees and sixty degrees with respect to each said longitudinal hexagonal side and with respect to each said transverse hexagonal side; and said negatively diagonal hexagonal side is oriented in the approximate range between thirty degrees and sixty degrees with respect to each said longitudinal hexagonal side and with respect to each said transverse hexagonal side; and for each said octagonal aperture:

said positively diagonal octagonal sides are equal;

said negatively diagonal octagonal sides are equal;

each said positively diagonal octagonal side is unequal to each said negatively diagonal octagonal side;

each said positively diagonal octagonal side is oriented in the approximate range between thirty degrees and sixty degrees with respect to each said longitudinal octagonal side and with respect to each said transverse octagonal side;

each said negatively diagonal octagonal side is oriented in the approximate range between thirty degrees and sixty degrees with respect to each said longitudinal octagonal side and with respect to each said transverse octagonal side.

24. A plural-level structure as in claim 21, comprising at least two consecutive said partitions for separating at least three vertically consecutive said levels of said plural-level structure, each said partition being approximately identically provided with at least six said hexagonal apertures and at least four said octagonal apertures for permitting communication between said at least three separated levels, said at least two consecutive partitions being configured whereby the corresponding said arrangements are approximately in vertical spatial alignment.

25. A plural-level structure as in claim 21, comprising at least one wall which engages at least one said partition, said wall at least substantially traversing said partition so as not to encroach upon any said hexagonal aperture, and so as not to encroach upon any said octagonal aperture.

* * * * *